US012455149B2

(12) United States Patent
MacGillivray et al.

(10) Patent No.: US 12,455,149 B2
(45) Date of Patent: Oct. 28, 2025

(54) SHAPED CHARGE WITH REACTIVE MATERIAL

(71) Applicant: Halliburton Energy Services, Inc., Houston, TX (US)

(72) Inventors: Joseph Todd MacGillivray, Alvarado, TX (US); Jason Paul Metzger, Alvarado, TX (US); Stuart Michael Wood, Alvarado, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/590,346

(22) Filed: Feb. 28, 2024

(65) Prior Publication Data

US 2025/0271243 A1 Aug. 28, 2025

(51) Int. Cl.

| | |
|---|---|
| ***F42B 1/02*** | (2006.01) |
| ***E21B 43/117*** | (2006.01) |
| ***F42B 1/028*** | (2006.01) |
| ***F42B 1/032*** | (2006.01) |
| ***F42B 3/08*** | (2006.01) |

(52) U.S. Cl.

CPC ..... *F42B 1/02* (2013.01); *E21B 43/117* (2013.01); *F42B 1/028* (2013.01); *F42B 1/032* (2013.01); *F42B 3/08* (2013.01)

(58) Field of Classification Search

CPC .. F42B 1/02; F42B 1/028; F42B 1/032; F42B 1/036; F42B 3/08; E21B 43/116; E21B 43/117

USPC ..... 102/306, 310

See application file for complete search history.

(56) References Cited

U.S. PATENT DOCUMENTS

| | | | | |
|---|---|---|---|---|
| 5,792,977 | A | 8/1998 | Chawla | |
| 5,827,995 | A * | 10/1998 | Graham | F42B 1/032 102/307 |
| 6,393,991 | B1 | 5/2002 | Funston et al. | |
| 7,278,353 | B2 | 10/2007 | Langan et al. | |
| 8,794,153 | B2 | 8/2014 | Glenn | |
| 8,851,191 | B2 * | 10/2014 | Mhaskar | E21B 29/02 166/299 |
| 9,080,432 | B2 * | 7/2015 | Yang | F42B 1/032 |
| 9,617,194 | B2 | 4/2017 | Glenn | |
| 9,862,027 | B1 | 1/2018 | Loehken | |
| 10,739,115 | B2 | 8/2020 | Loehken et al. | |

(Continued)

FOREIGN PATENT DOCUMENTS

| | | | | |
|---|---|---|---|---|
| WO | WO-03091184 A2 * | 11/2003 | | C06C 5/04 |
| WO | 2023278995 | 1/2023 | | |

OTHER PUBLICATIONS

"PCT Application No. PCT/US24/17781 International Search Report and Written Opinion", Dec. 4, 2024, 10 pages.

*Primary Examiner* — James S Bergin

(74) *Attorney, Agent, or Firm* — DeLizio, Peacock, Lewin & Guerra LLP

(57) ABSTRACT

Some implementations include an apparatus comprising an explosive material configured to detonate; a liner in contact with the explosive material, the liner configured to, after detonation of the explosive material, form jets to perforate a tubular disposed in a subsurface borehole; a reactive material configured to release energy in response to detonation of the explosive material; and a case in contact with a portion of the reactive material and configured to surround the explosive material, the liner, and the reactive material.

11 Claims, 8 Drawing Sheets

(56) References Cited

U.S. PATENT DOCUMENTS

| | | | | |
|---|---|---|---|---|
| 2008/0289529 | A1* | 11/2008 | Schilling | F42B 1/032<br>102/307 |
| 2009/0078420 | A1 | 3/2009 | Caminari et al. | |
| 2015/0362297 | A1 | 12/2015 | Yang et al. | |
| 2016/0209187 | A1* | 7/2016 | Stecher | F42B 12/10 |
| 2018/0045025 | A1 | 2/2018 | Bird | |

* cited by examiner

SHAPED CHARGE WITH REACTIVE MATERIAL

TECHNICAL FIELD

The disclosure generally relates to the field of subsurface operations and, more specifically, to a shaped charged that may be used in subsurface hydraulic fracturing operations.

BACKGROUND

Shaped charges may be used in operations for hydraulic fracturing ("fracking"). Prior to hydraulic fracking operations, a wellbore may be drilled into a subsurface rock formation and line with casing. Shaped charges may be used to create perforations in wellbore casing and the formation. These perforations may serve as pathways for hydraulic fracturing fluids to flow from the wellbore into the rock to create fractures in the rock.

BRIEF DESCRIPTION OF THE DRAWINGS

Aspects of the disclosure may be better understood by referencing the accompanying drawings.

DESCRIPTION

The description that follows includes example systems, methods, techniques, and operational flows that embody aspects of the disclosure. However, this disclosure may be practiced without these specific details. For clarity, some well-known structures and techniques have been omitted.

Overview

Shaped charges may be used for fracking and other operations for resource recovery. Traditionally, shaped charges may include an outer case surrounding an explosive material and a liner. The explosive material may be sandwiched between the case and the liner. As the explosive material detonates, there may be reactive forces created by explosive gases contacting the case. Some implementations increase these reactive forces by adding a layer of reactive material in contact with the case (such as by lining a portion of the case with reactive material). The reactive material may generate increased pressures in the wellbore and perforations in the formation. The reactive material may generate additional pressure near the case, thus increasing the amount of energy imparted on the liner—more than would result from merely adding mass to the case. As a result, the liner may collapse and jet at higher velocities than in traditional shaped charges. Some implementations may configure the geometry of the reactive material, explosive material, and other components to achieve various results. For example, placing reactive material near the apex of a conoidal case may create certain energy waves, pressures, and temperatures whereas placing the reactive material in other locations may achieve different energy waves, pressures, temperatures, and other conditions.

Description of Some Implementations

Figure 1:
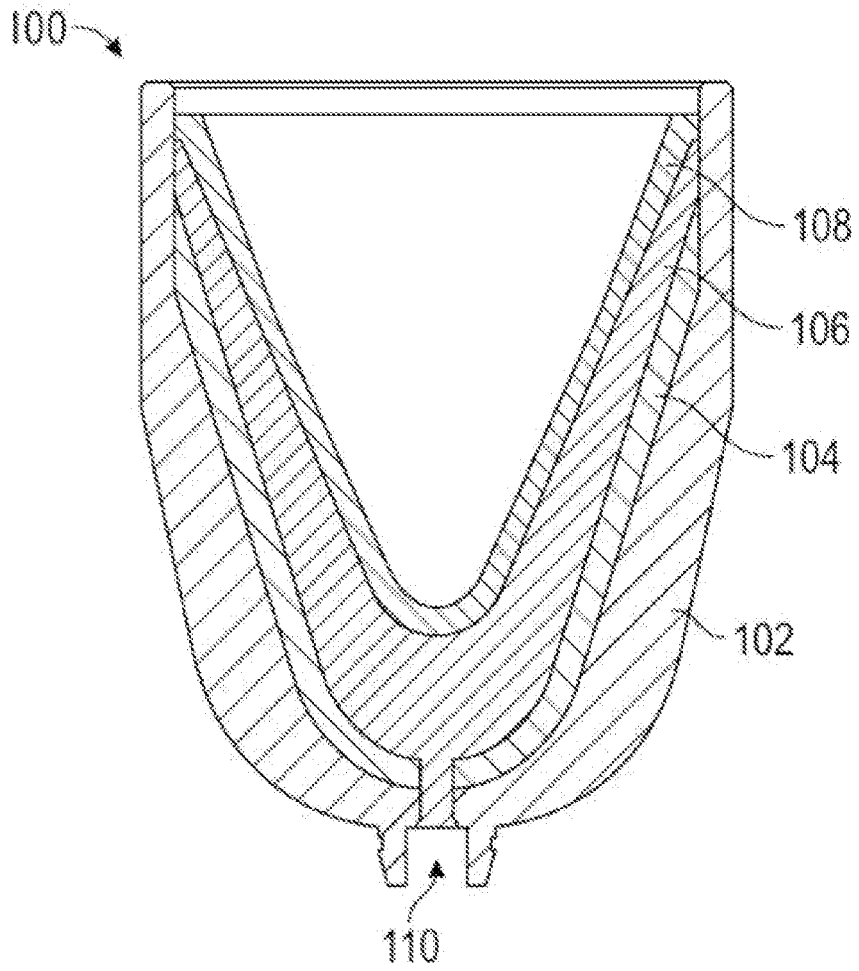
FIG. 1 is a diagrammatic illustration of a shaped charge.

FIG. 1 is a diagrammatic illustration of a shaped charge. In FIG. 1, the shaped charge 100 may include a liner 108, explosive material 106, reactive material 104, and a case 102. The case 102 may be configured to surround the liner 108, explosive material 106, and reactive material 104. The case 102 may be comprised of nonreactive material such as steel or other suitable materials. In some implementations, the case 102 itself may include a reactive material such as zinc.

The case 102 also may include an orifice 110 that may accommodate a detonator or other device used with the shaped charge 100. In some implementations, the case 102 is conoidal but may take any suitable geometric form.

The liner 108 may be conoidal or any suitable geometric form. The liner 108 may be constructed from tungsten, copper, brass, aluminum, blended powder metals, or other suitable materials. The explosive material 106 may include one or more of the following explosive materials: Cyclotetramethylene-tetranitromine, Cyclotrimethylenetrinitramine, Hexanitrostilbene, pentaerythritol tetranitrate, Hexanitrohexaazaisowurtzitane, triaminotrinitrobenzene, 2,2',2",4,4',4",6,6',6"-Nonanitro-m-terphenyl, and 2,6-Bis (picrylamino)-3,5-dinitropyridine. The explosive material 106 may be conoidal or any suitable geometric form.

The reactive material 104 may be placed on an interior surface of the case 102. In some implementations, the reactive material 104 may include one or more of the following materials: tin, chromium, aluminum, magnesium, titanium, tungsten, and tantalum. Other suitable reactive materials that are not metal include certain rubbers, polyethylene, polytetrafluoroethylene (e.g., TEFLON). The reactive material 104 may include any combination of these materials and any other suitable materials. The reactive material 104 be made from materials that are typically inert.

Operation of the shaped charge 100 may be initiated by detonating the explosive material 106. As the explosive material 106 detonates, the explosion creates forces acting on the components of the shaped charge 100. The following variables and equations represent aspects and forces that relate to detonation of the explosive material 106 in the shaped charge 100.

M—mass of the liner 108

C—mass of the explosive material 106

E—energy per mass of the explosive material 106

N—mass of the case 102

A—Gurney constant relating the velocity of the liner 108 to the detonation properties of the explosive material 106

$$V_M = \sqrt{2E}\left[\frac{1+A^3}{3(1+A)} + \frac{N}{C}A^2 + \frac{M}{C}\right]^{-\frac{1}{2}} \tag{1}$$

$$V_N = AV_M \tag{2}$$

$$A = \frac{1+2\frac{M}{C}}{1+2\frac{N}{C}} \tag{3}$$

Equations 1-3 indicate that an increase in the mass of the case 102 (N) may cause a decrease to the Gurney constant (A) which may increase the velocity of the liner 108 ($V_M$).

Figure 2:
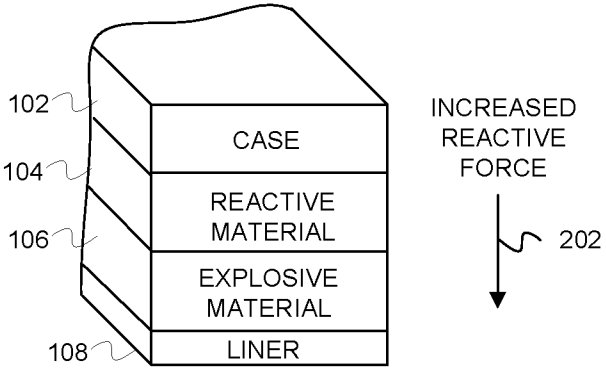
FIG. 2 is a diagram illustrating forces from detonating the shaped charge.

FIG. 2 is a diagram illustrating forces from detonating the shaped charge. As the explosive material 106 detonates, a reactive force 202 between the pressure of the explosive gases and the case 102 (N) may impart additional energy of the explosive gas on the liner (M). In some implementations, placing the reactive material 104 on an inner surface of the case 102 increases the reactive force by generating additional pressure near the case 102 (N), thus increasing the amount of energy imparted on the liner (M)—more than by merely adding additional mass to the case 102. After detonation, the liner 108 may collapse and therefore jet at higher velocities than without the reactive material 104 placed in contact with the case 102.

FIGS. 3-6 are diagrammatic illustrations of shaped charges. In each of FIGS. 3-6, the respective geometries of the reactive material 104 and explosive material 106 are different. The thickness, volume, and location of the reactive material 104 may vary depending on the desired results of the shaped charge 101. In some instances, the geometric properties of the reactive material 104 may affect those of the explosive material 106. In some embodiments (not shown in FIGS. 3-6), the geometry of any component may be modified to achieve desired results. Irrespective of the geometries, placing a portion of the reactive material 104 in contact with the case may cause increase reactive forces inside the case 102 and achieve desired velocities, temperatures, and other effects. For example, a first configuration of the shape charge 100 with particular respective component geometries may be suitable to create reactive forces in the case 102 that create holes in a tubular (such as downhole casing) of a desired size. A second configuration with different respective component geometries may be suitable for deep holes in the formation. However, both configurations may include reactive material 104 in contact with the case 102.

Figure 3:
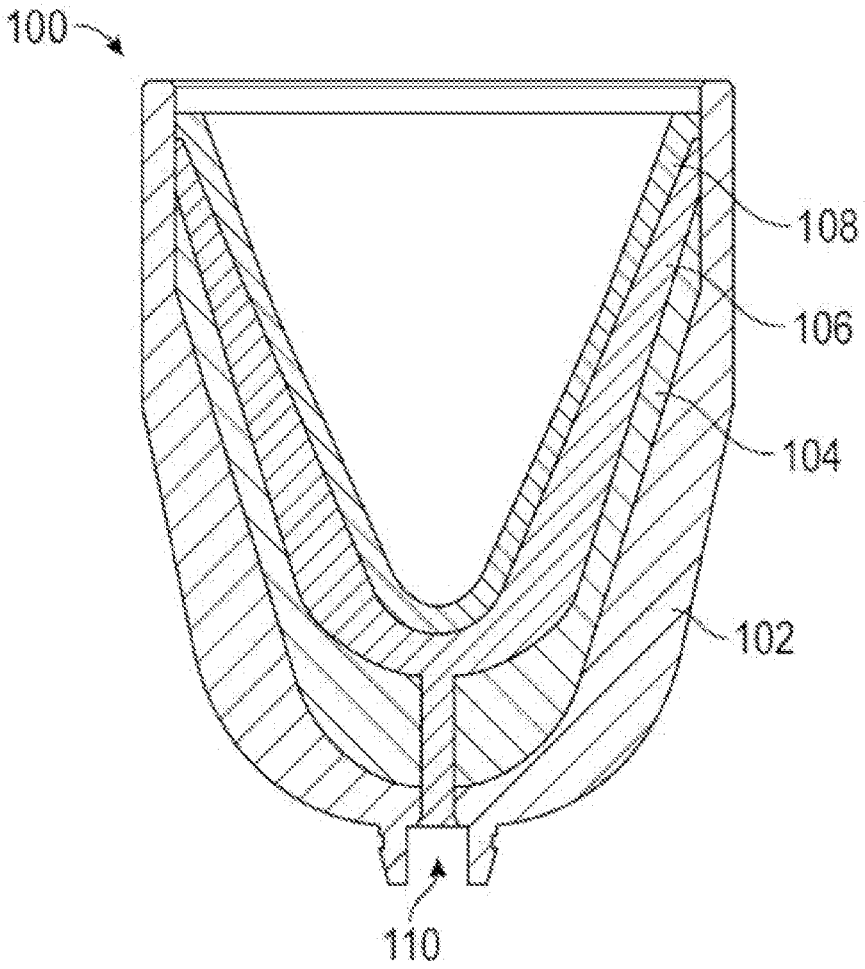
FIGS. 3-6 are diagrammatic illustrations of shaped charges.

In FIG. 3, the reactive material 104 forms a layer on conoidal inner surface of the case 102. The layer of reactive material 104 may span from an edge of the orifice 110 to a base of the conoidal inner surface. The layer of reactive material 104 may have uniform thickness.

Figure 4:
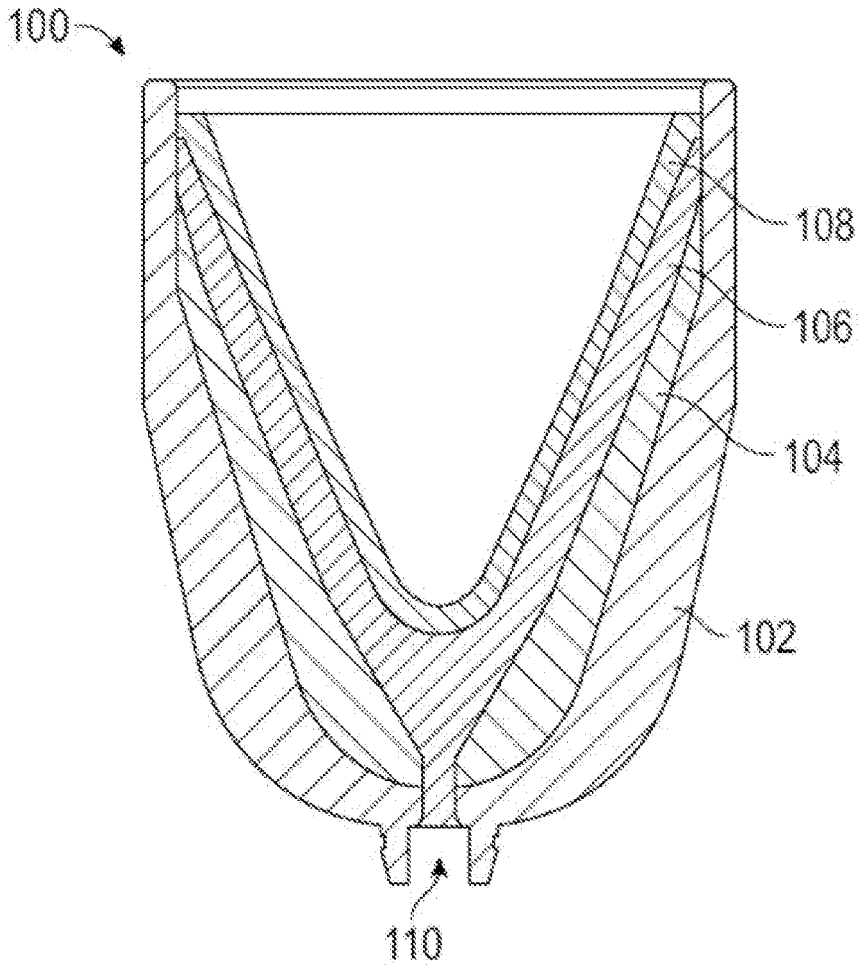

In FIG. 4, the reactive material 104 spans from the orifice edge to the base of the conoidal inner surface. However, in FIG. 4, the reactive material 104 does not have uniform thickness. In FIG. 4, the reactive material 104 is thickest near the orifice 110 while gradually thinning toward the base of the conoidal inner surface of the case 102. In some implementations, the volume including the reactive material 104 and the explosive material is constant. For these implementations, as the amount of reactive material 104 increases, the amount of explosive material 106 decreases (and vice versa).

Figure 5:
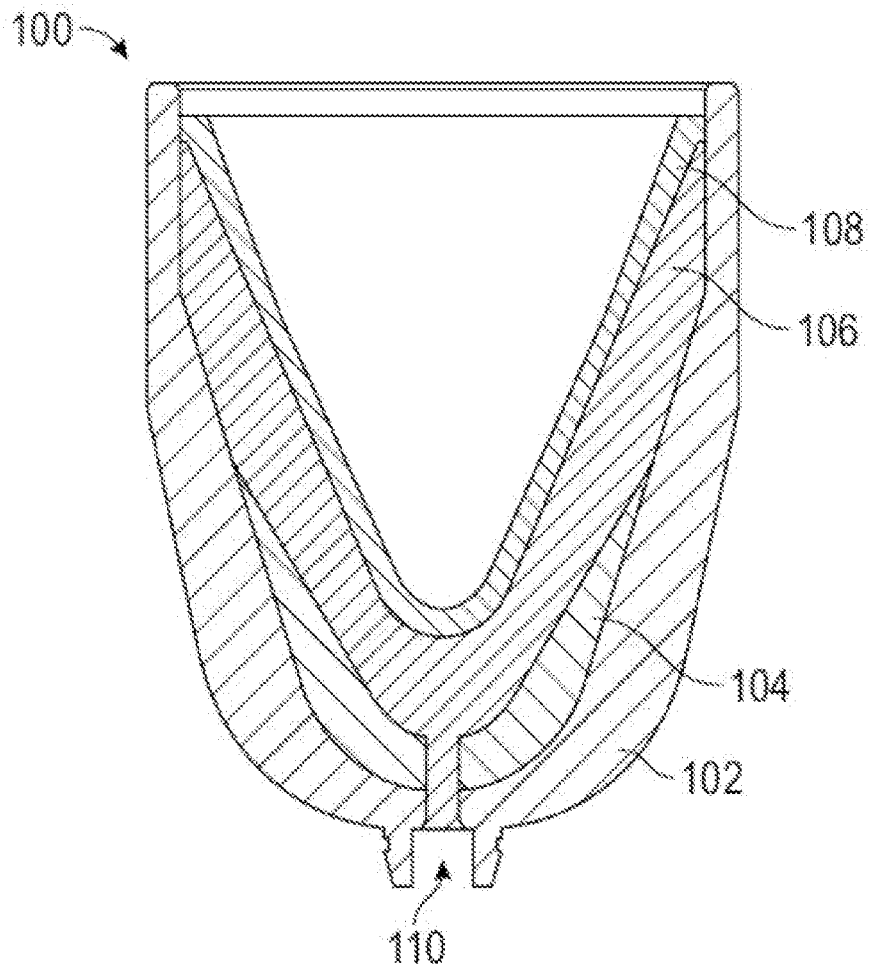
Figure 6:
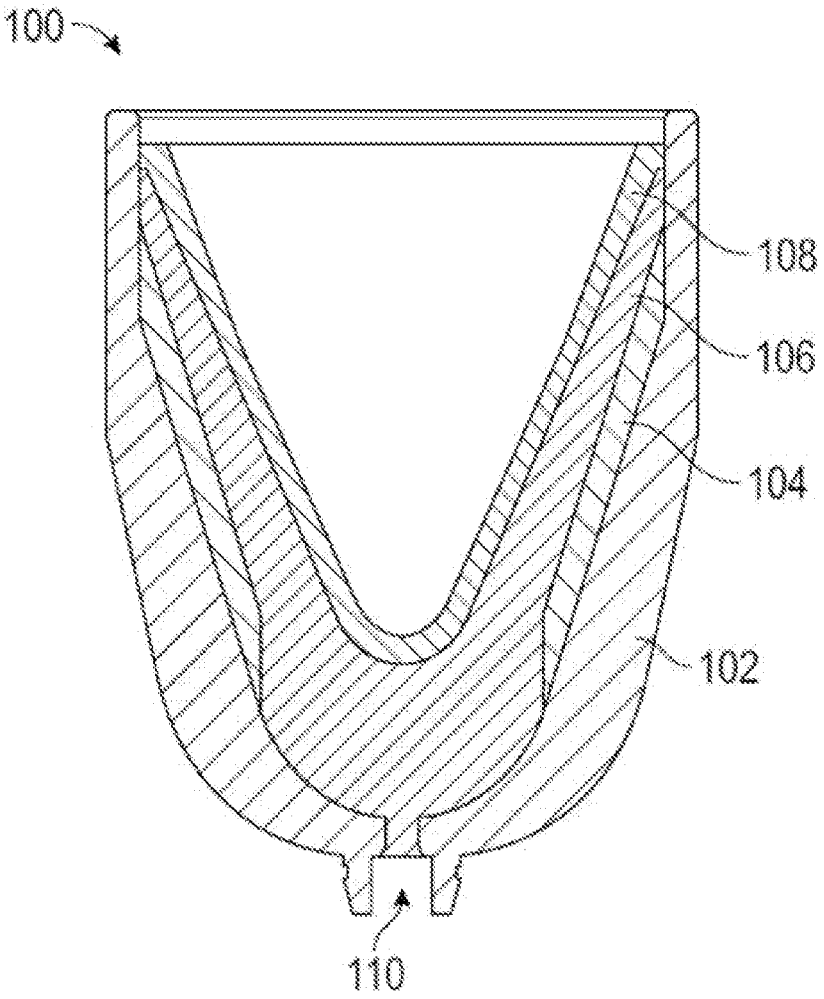

In FIG. 5, the reactive material 104 begins at the orifice edge and spans about ⅔ the distance between the orifice 110 and the base of the conoidal inner surface of the case 102. In FIG. 6, the reactive material 104 begins at the base of the conical inner surface of the case 102 and runs toward the orifice 110. The reactive material 104 has tapered thickness at its ends with uniform thickness everywhere else. As noted, the geometries of the components in the shaped charge 100 may vary depending on the desired functionality. In some implementations, the reactive material 104 may take any suitable shape whereby at least a portion of the reactive material 104 is in contact with the case.

Figure 7:
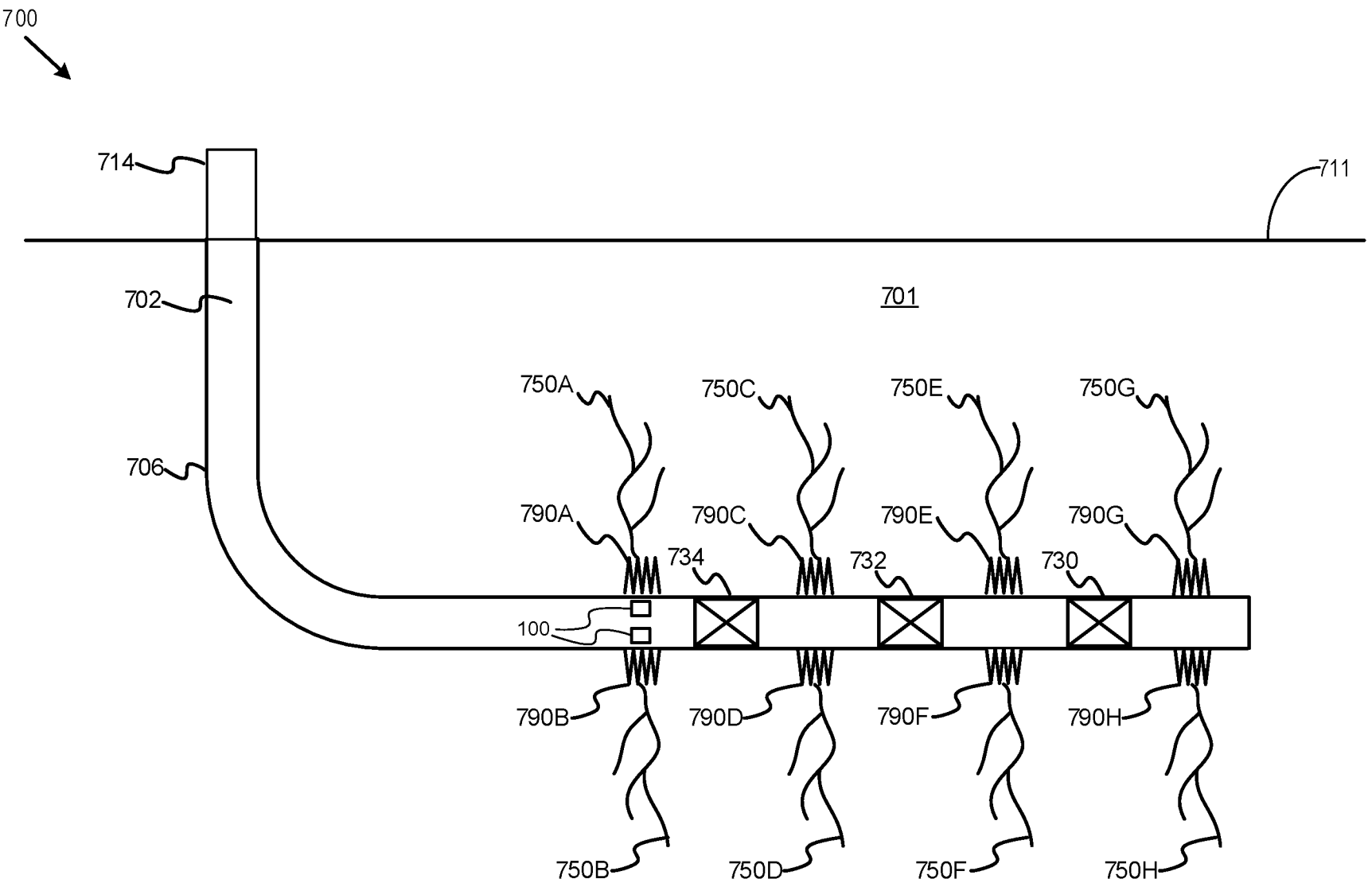
FIG. 7 is an illustration depicting an example well system, according to some implementations.

In some implementations, one or more shaped charges 100 may be utilized in various downhole scenarios. For example, one or more shaped charges 100 may be utilized for fracking in a well system. FIG. 7 is an illustration depicting an example well system, according to some implementations. In particular, FIG. 7 is a schematic of a well system 700 that includes a wellbore 702 in a subsurface formation 701. The wellbore 702 may include a casing 706. Shaped charges 100 may be used to create perforations 790A-790H in the casing 706 at different depths. Although not shown, the shaped charges 100 may be utilized in concert with a perforation gun or other device for creating the perforations in the casing 706. During fracking of the wellbores 702, fracturing fluid (with or without sand) may be pumped into the subsurface formation 701 via the perforations 790A-790H. The fracturing fluid may create fractures 750A-750H in the subsurface formation such that reservoir fluid may flow into the wellbore 702. In some implementations, the wellbore 702 may be hydraulically fractured in stages. For example, a first stage may include hydraulically fracturing the perforations 790G, 790H to generate fractures 750G, 750H, respectively. After fracking the first stage, a frac plug 730 may be positioned in the casing 706 above the first stage (i.e., at a lesser depth in the wellbore than perforations 790G, 790H). After setting the frac plug 730, a sealing component (such as a ball, dart, etc.) may be positioned in the frac plug 730 to prevent hydraulic communication between the portion of the wellbore 702 below the frac plug 730 (i.e., the first stage that was hydraulically fractured) and the portion of the wellbore 702 above the frac plug 730. Once the sealing component is positioned in the frac plug 730, the perforations 790E, 790F may be formed in the casing 706 and hydraulic fracturing operations may commence for the next stage. Similar operations may be repeated for each subsequent stage (i.e., setting frac plug 732 and frac plug 734 and using the shaped charges 100 for hydraulically fracturing the next stage) until hydraulic fracturing operations for the wellbore 702 are complete.

Figure 8:
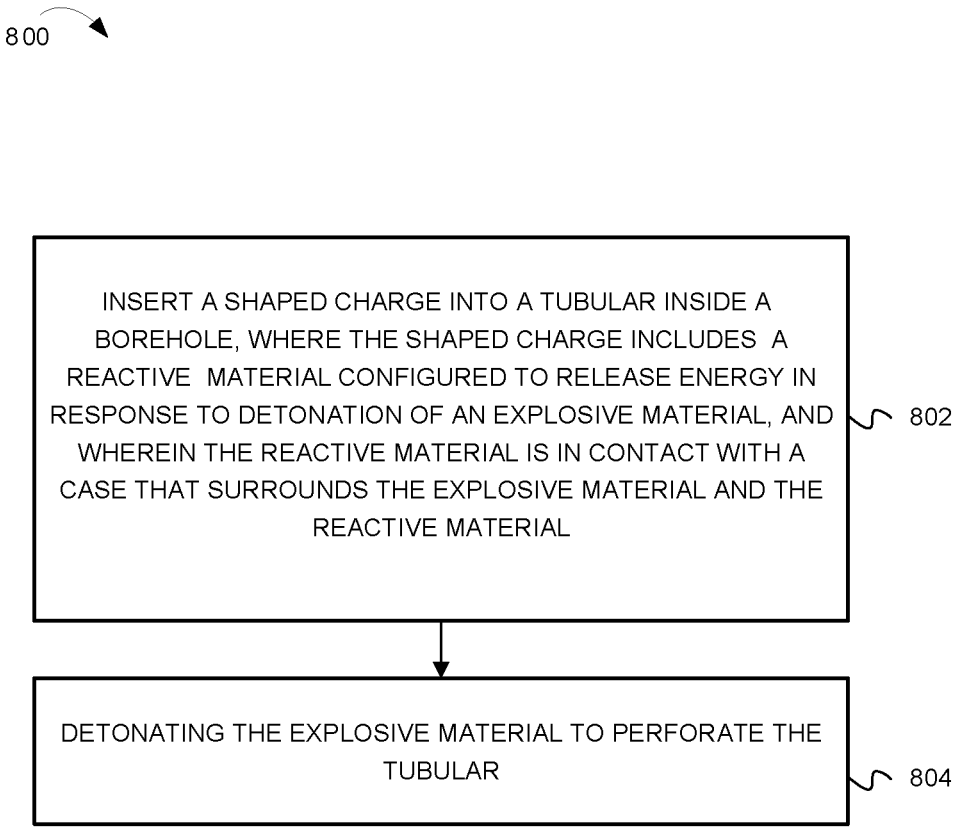
FIG. 8 is a flow diagram illustrating operations for an example method.

FIG. 8 is a flow diagram illustrating operations for an example method. At block 802, a shaped charge is inserted into a tubular inside a borehole, the shaped charge including a reactive material configured to release energy in response to detonation of an explosive material, wherein the reactive material is in contact with a case that surrounds the explosive material and the reactive material. At block 804, the shaped charge is detonated to perforate the tubular.

As used herein, the term "or" is inclusive unless otherwise explicitly noted. Thus, the phrase "at least one of A, B, or C" is satisfied by any element from the set {A, B, C} or any combination thereof, including multiples of any element.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, and the principles and the novel features disclosed herein.

The various implementations may include some implementations that have all or any combination of the aspects described herein.

Some implementations may aspects as described in the following clauses.

Clause 1: An apparatus comprising: an explosive material configured to detonate; a liner in contact with the explosive material, the liner configured to, after detonation of the explosive material, form jets to perforate a tubular disposed in a subsurface borehole; a reactive material configured to release energy in response to detonation of the explosive material; and a case in contact with a portion of the reactive material and configured to surround the explosive material, the liner, and the reactive material.

Clause 2: The apparatus of clause 1, wherein the reactive material includes at least one material selected from the group consisting of rubber, polyethylene, and polytetrafluoroethylene.

Clause 3: The apparatus of any one or more of clauses 1-2, wherein the reactive material is in further contact with a portion of the explosive material.

Clause 4: The apparatus of any one or more of clauses 1-3, wherein the reactive material forms a layer in contact with an inner surface of the case.

Clause 5: The apparatus of any one or more of clauses 1-4, wherein the case has a conoidal shape, and wherein the reactive material spans from an orifice at an apex of the conoidal shape to a base of the conoidal shape.

Clause 6: The apparatus of any one or more of clauses 1-5, wherein thickness of the reactive material increases from the orifice to the base.

Clause 7: The apparatus of any one or more of clauses 1-6, wherein the reactive material is tapered at one or more edges.

Clause 8: A system comprising: a shaped charge including an explosive material configured to detonate, a liner in contact with the explosive material, the liner configured to, after detonation of the explosive material, form jets to perforate a tubular disposed in a subsurface borehole, a reactive material configured to release energy in response to detonation of the explosive material, and a case in contact with a portion of the reactive material and configured to surround the explosive material, the liner, and the reactive material; and a perforation device configured to operate with the shaped charge to perforate the tubular in the subsurface borehole.

Clause 9: The system of clause 8, wherein the reactive material includes at least one material selected from the group consisting of rubber, polyethylene, and polytetrafluoroethylene.

Clause 10: The system of any one or more of clauses 8-9, wherein the reactive material is in further contact with a portion of the explosive material.

Clause 11: The system of any one or more of clauses 8-10, wherein the reactive material forms a layer in contact with an inner surface of the case.

Clause 12: The system of any one or more of clauses 8-11, wherein the case has a conoidal shape, and wherein the reactive material spans from an orifice at an apex of the conoidal shape to a base of the conoidal shape Clause 13: The system of any one or more of clauses 8-12, wherein thickness of the reactive material increases from the orifice to the base.

Clause 14: The system of any one or more of clauses 8-13, wherein the reactive material is tapered at one or more edges.

Clause 15: A method comprising: inserting a shaped charge into a tubular inside a borehole, the shaped charge including a reactive material configured to release energy in response to detonation of an explosive material, wherein the reactive material is in contact with a case that surrounds the explosive material and the reactive material; and detonating the explosive material to perforate the tubular.

Clause 16: The method of clause 15, wherein the reactive material is in further contact with a portion of the explosive material.

Clause 17: The method of any one or more of clauses 15-16, wherein the reactive material forms a layer in contact with an inner surface of the case.

Clause 18: The method of any one or more of clauses 15-17, wherein the case has a conoidal shape, and wherein the reactive material spans from an orifice at an apex of the conoidal shape to a base of the conoidal shape.

Clause 19: The method of any one or more of clauses 15-18, wherein thickness of the reactive material increases from the orifice to the base.

Clause 20: The method of any one or more of clauses 15-19, wherein the reactive material is tapered at one or more edges.

What is claimed is:

1. An apparatus comprising:

an explosive material configured to detonate;

a liner in contact with the explosive material, the liner configured to, after detonation of the explosive material, form jets to perforate a tubular disposed in a subsurface borehole;

a reactive material configured to release energy in response to detonation of the explosive material; and a case with a conoidal shape in contact with the liner and a portion of the reactive material and configured to surround the explosive material, the liner, and the reactive material, wherein a thickness of the reactive material increases as the reactive material spans from an orifice at an apex of the conoidal shape substantially to a base of the conoidal shape.

2. The apparatus of claim 1, wherein the reactive material includes at least one material selected from the group consisting of rubber, polyethylene, and polytetrafluoroethylene.

3. The apparatus of claim 1, wherein the reactive material forms a layer in contact with an inner surface of the case.

4. The apparatus of claim 3, wherein the reactive material is tapered at one or more edges.

5. A system comprising:

one or more shaped charges each including an explosive material configured to detonate, a liner in contact with the explosive material, the liner configured to, after detonation of the explosive material, form jets to perforate a tubular disposed in a subsurface borehole, a reactive material configured to release energy in response to detonation of the explosive material, and a case with a conoidal shape in contact with the liner and a portion of the reactive material and configured to surround the explosive material, the liner, and the reactive material, wherein a thickness of the reactive material increases as the reactive material spans from an orifice at an apex of the conoidal shape substantially to a base of the conoidal shape; and a perforation device configured to operate with the shaped charge to perforate the tubular in the subsurface borehole.

6. The system of claim 5, wherein the reactive material includes at least one material selected from the group consisting of rubber, polyethylene, and polytetrafluoroethylene.

7. The system of claim 5, wherein the reactive material forms a layer in contact with an inner surface of the case.

8. The system of claim 7, wherein the reactive material is tapered at one or more edges.

9. A method comprising:

inserting one or more shaped charges into a tubular inside a borehole, each shaped charge including a reactive material configured to release energy in response to detonation of an explosive material in contact with the liner, wherein the reactive material is in contact with a case with a conoidal shape that is in contact with the liner, wherein the case surrounds the explosive material, the liner, and the reactive material, and wherein a thickness of the reactive material increases as the reactive material spans from an orifice at an apex of the conoidal shape substantially to a base of the conoidal shape; and detonating the explosive material to perforate the tubular.

10. The method of claim 9, wherein the reactive material forms a layer in contact with an inner surface of the case.

11. The system of claim 10, wherein the reactive material is tapered at one or more edges.

* * * * *